United States Patent [19]

Reeves et al.

[11] Patent Number: 4,860,775

[45] Date of Patent: Aug. 29, 1989

[54] HAIR BRUSH

[75] Inventors: Kevin E. Reeves, Trumbull; Daniel Santhouse, Stratford, both of Conn.

[73] Assignee: Clairol Incorporated, New York, N.Y.

[21] Appl. No.: 168,566

[22] Filed: Mar. 7, 1988

Related U.S. Application Data

[63] Continuation of Ser. No. 916,929, Oct. 8, 1986, abandoned.

[51] Int. Cl.[4] ..... A45D 24/10

[52] U.S. Cl. ..... 132/118; 132/229

[58] Field of Search ..... 132/11 R, 33 R, 36 R, 132/85, 118, 120, 126, 139, 142, 150, 161; D28/28, 29, 32, 33, 35, 37, 38; 219/222

[56] References Cited

U.S. PATENT DOCUMENTS

| | | | |
|---|---|---|---|
| D. 152,203 | 12/1948 | Mayer | D4/133 |
| D. 207,938 | 6/1967 | Pedersen | D86/10 |
| D. 226,587 | 3/1973 | Keldmann | D86/10 E |
| D. 229,447 | 11/1973 | Jensen . | |
| D. 251,781 | 10/1969 | Tolmie | 219/222 X |
| 2,507,373 | 5/1950 | Finkelstein | 132/150 |
| 3,459,199 | 8/1969 | Connell | 132/11 |
| 3,472,245 | 10/1969 | Abe | 132/33 |
| 3,480,019 | 11/1969 | Popiel | 219/222 X |
| 3,527,237 | 9/1970 | Abe | 132/40 |
| 3,696,819 | 10/1972 | Jensen | 132/33 R |
| 3,739,788 | 6/1973 | Keldmann | 132/33 R |
| 3,766,930 | 10/1973 | Madsen et al. | 132/33 R |
| 4,329,567 | 5/1982 | Kunz et al. | 219/222 |
| 4,468,554 | 8/1984 | Andis | 132/118 X |
| 4,486,915 | 12/1984 | Stewart et al. | 15/187 |
| 4,593,708 | 6/1986 | Goiller et al. | 132/9 |

FOREIGN PATENT DOCUMENTS 115190 of 0000 Japan .

*Primary Examiner*—Robert Peshock
*Assistant Examiner*—R. Thomas Price
*Attorney, Agent, or Firm*—Gene Warzecha

[57] ABSTRACT

A heatable hair brush capable of being utilized for either curling or straightening hair as desired. The hair brush is also capable of being molded with integral bristles in a relatively simple two-part mold. The hair brush has a hairwinding portion provided with a plurality of longitudinally spaced bristles arranged in a pair of diametrically opposed sets of parallel bristle rows, the central row of each set being radially extended and the rows on either side of the central row being parallel thereto.

5 Claims, 2 Drawing Sheets

HAIR BRUSH

This is a continuing application of Application Ser. No. 916,929 filed Oct. 8, 1986 now abandoned.

BACKGROUND OF THE INVENTION

1. Field of the Invention

The invention generally relates to hair grooming appliances. More particularly, the invention relates to heatable hair brushes.

2. Description of the Prior Art

Hair brushes are well known in the prior art and comprise a generally elongated handle to which is attached an axially aligned hairwinding portion formed as a base having a plurality of outwardly extending bristles. Hair brushes are available as either heatable or non-heatable units, as well as units having either a rotatable or non-rotatable hairwinding portion. Heatable hair brushes are often provided with self-contained means for heating the hairwinding portions, although the heating means is conventional and forms no part of this invention.

Non-heatable hair brushes are used merely for brushing hair or for styling it with the assistance of an auxiliary heat source such as a blow dryer. Heatable hair brushes are used for brushing as well as styling by setting or curling hair and do not require auxiliary heat sources. The bristle patterns on non-heatable hair brushes vary considerably. However, on all known heatable hair brushes the hairwinding portion is generally cylindrical and formed as a base or barrel with the bristles being longitudinally spaced along and radially extending from the barrel and annularly symmetrical about the barrel axis. Example of such prior art heatable hair brushes are shown in U.S. Pat. Nos. 4,486,915 (Stewart et al), No. 4,329,567 (Kunz et al) and No. 4,593,708 (Goeller et al), all assigned to the assignee hereof.

Heatable hair brushes may be manufactured with the bristles being either integrally formed with the barrel (as shown in the aforementioned Stewart et al and Kunz et al patents) or made of dissimilar material and attached to the barrel (as shown in the aforementioned Goeller et al patent). Integral-bristle hair brushes are generally injection molded from a suitable plastic material and, because of the symmetrical bristle arrangement, require use of a multi-part mold. This complexity obviously increases the manufacturing cost. The cost is also relatively high in non-integral-bristle hair brushes because of the parts and labor required to provide the annularly symmetrical bristle arrangement.

In addition to the increased cost of heatable hair brushes having annularly symmetrically arranged bristles, there is a limitation associated with the use of such brushes. As is well understood by those skilled in the art, such brushes are suitable for styling hair by applying heat to the hair as it is manipulated by the brush. In the use of such brushes to straighten hair or to relax curls or waves set in hair, the brush is moved through the hair without being rotated about the barrel axis as it would be to curl the hair. The bristles hold the hair under tension while the heat of the barrel and bristles break the set so that as the hair cools and sets under tension it will become straighter. The application of a predetermined amount of heat is necessary for this operation, although excessive heat will burn the hair. In annularly symmetrical type brushes, whether the bristles are integrally formed or not, the periodic longitudinal spacing of the bristles causes the hair to gather into a clump between adjacent longitudinally spaced bristles. This necessarily results in the hair touching the barrel getting more heat than the hair further away from the barrel, thus creating a risk of burning some of the hair before enough heat is applied to relax the outer layers. It is apparent that prior art brushes are optimized for styling or curling rather than straightening the hair.

It is accordingly an object of this invention to produce a hair brush which may be relatively inexpensively manufactured. It is a further object of this invention to produce a hair brush capable of being injection molded in a two-part mold.

It is also an object of this invention to produce a hair brush capable of being used for either curling or straightening hair as desired. It is yet another object of this invention to produce a hair brush suitable for straightening hair while minimizing the risk of burning the hair before it is sufficiently straightened.

SUMMARY OF THE INVENTION

These and other objects of this invention are achieved by the preferred embodiment thereof which comprises, in a hair brush having a handle and an elongated hairwinding portion attached thereto, the hairwinding portion provided with a plurality of longitudinally spaced bristles along its length, the improvement comprising a first set of a first plurality of parallel rows of said bristles extending in one direction from said hairwinding portion, and a second set of a second plurality of parallel rows of said bristles extending from said hairwinding portion in a direction diametrically opposite to said one direction. In the preferred embodiment each set has three rows and each of the rows in one set is coplanar with a corresponding row in the other set.

DESCRIPTION OF THE PREFERRED EMBODIMENT

Figure 1:
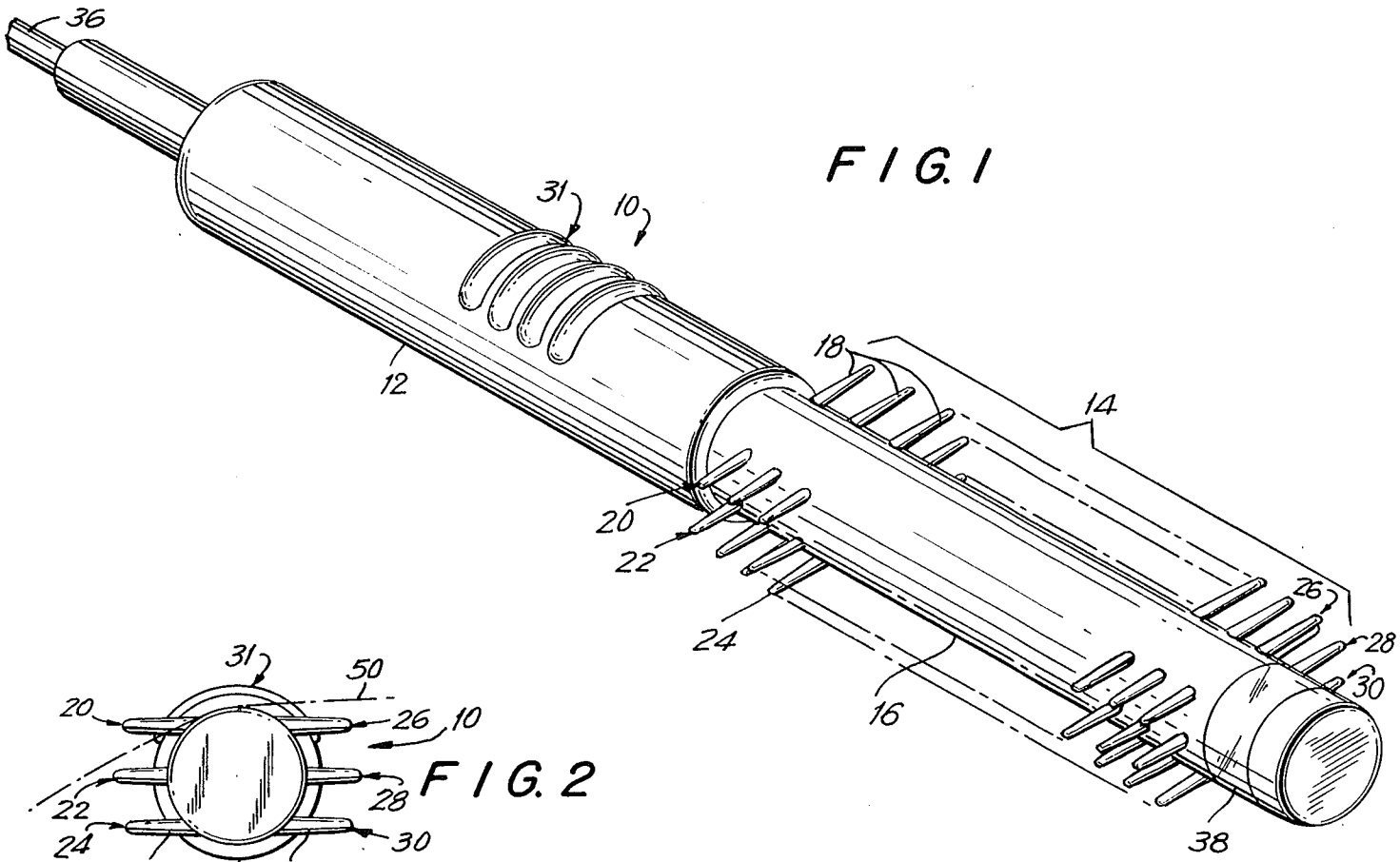
FIG. 1 is a front perspective view of a hair brush constructed in accordance with the principles of this invention.

Referring now to FIG. 1, there is shown a front perspective view of a hair brush 10 constructed in accordance with the principles of this invention. Hair brush 10 comprises a handle 12 and a hairwinding portion 14. In the preferred embodiment, hairwinding portion 14 is not rotatable relative to handle 12, although it could be made rotatable without detracting from the advantages of the invention.

Figure 2:
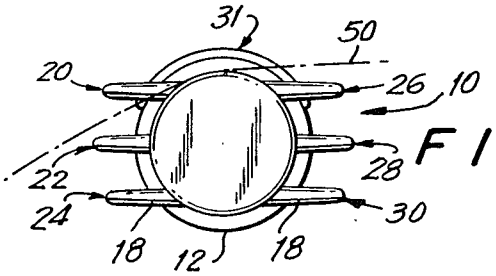
FIG. 2 is a right end elevational view of FIG. 1 showing by dotted line a path of a hair trees through the brush.
Figure 3:
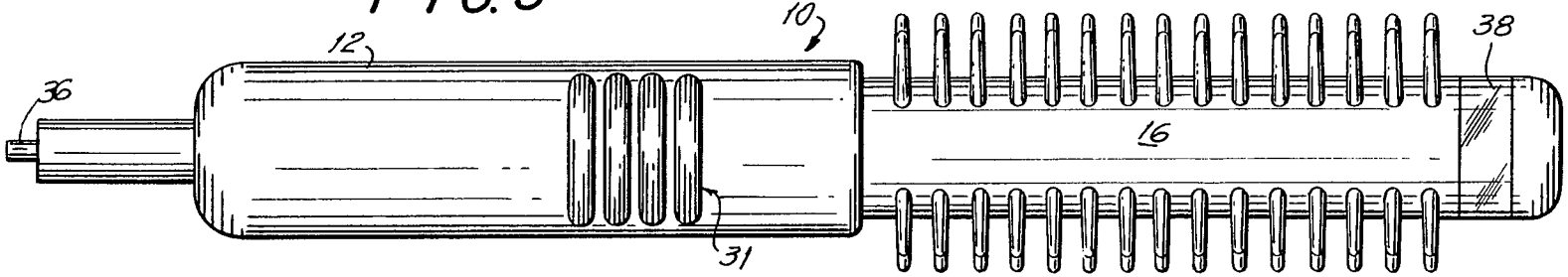
FIG. 3 is a side elevational view of FIG. 1.
Figure 4:
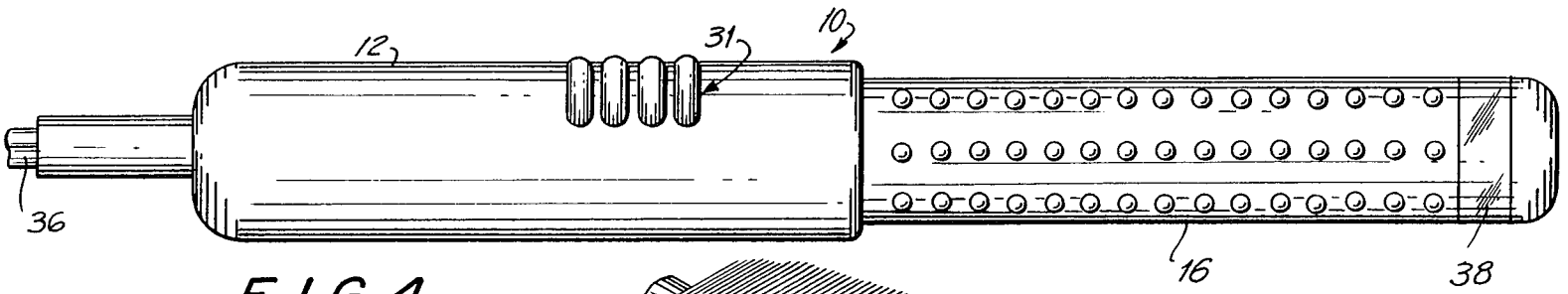
FIG. 4 is a bottom plan view of FIG. 1.

Hairwinding portion 14 comprises a barrel 16 to which are secured a plurality of bristles 18. The bristles are longitudinally spaced along the barrel and are formed into two symmetrical sets of three rows each. As best seen in FIG. 2, the top set of rows comprises rows 20, 22 and 24 and the bottom set comprises rows 26, 28 and 30. Rows 22 and 28 are coplanar and radially extending on opposite sides of barrel 16. Rows 20 and 24 are parallel to row 22 and spaced a predetermined distance therefrom. Similarly, rows 26 and 30 are parallel to row 28 and spaced a like predetermined distance therefrom. Rows 20 and 26 are coplanar as well as rows 24 and 30. As best seen in FIG. 2, rows 20, 26 and 24, 30 are inset somewhat from the perimeter of barrel 16 although it will be understood that a variety of arrangements would be operable ranging from placing these rows tangential to the barrel to placing them a relatively small predetermined distance from the central rows.

Since hairwinding portion 14 is not annularly symmetrical, it is desirable to provide a tactile index means 31 to provide an indication to the user of the position of the bristles relative to the user's hand. In the preferred embodiment, index means 31 is a plurality of slightly raised indicia or ridges molded into handle 12 at a predetermined position relative to the bristles of the hairwinding portion. It will be understood that numerous varieties of indicia could be used to provide a tactile reference for the user to orient the hair brush without looking at it.

Hair brush 10 is provided with a means for heating hairwinding portion 14. Electrical wires 36 are shown diagrammatically to indicate this fact, although it will be understood that any suitable heating means may be used including rechargeable batteries, butane powered catalytic or conventional combustion, etc. In the embodiment shown in the drawings, the electrical wires are operatively connected to a heating means within the interior of hairwinding portion 14 such as, for example, a conventional resistance wire heater or a positive temperature coefficient resistor. A translucent annular band 38 may be provided near the tip of hairwinding portion 14 in order to provide a power on/off indication by the illumination of a light (not shown) under band 38.

It will be understood that each of the bristles 18 may be shaped in a variety of profiles and lengths in addition to being spaced at different arcuate distances relative to the central rows of each set. Additionally, the pattern of rows may be altered such that the rows in one set need not necessarily be coplanar with the rows in the other set. The advantages of the invention are achieved by the parallel arrangement of bristles on the barrel. These advantages occur whether or not the bristles are integrally formed with the barrel. However, the manufacturing efficiencies provided by the invention are most apparent by forming the bristles integrally with the barrel in a single molding operation.

The manufacturing advantages of the invention are easily explained by noting that the barrel with integral bristles may be molded in a two-part mold having a mold parting line (not shown) along the barrel diameter perpendicular to the direction of the bristles. These advantages are apparent whether or not the hair brush is provided with means for heating the hairwinding portion.

Figure 5:
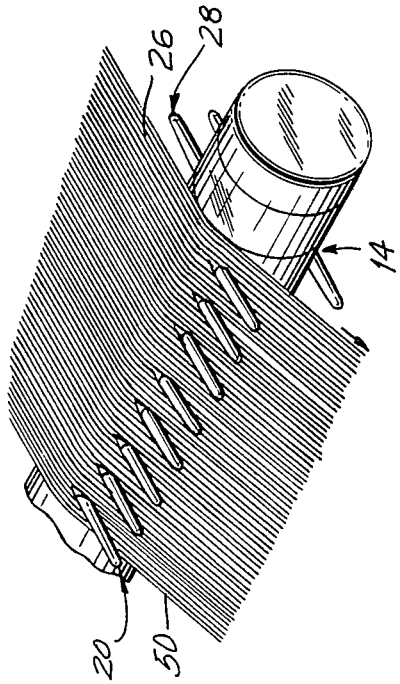
FIG. 5 is a diagrammatic perspective view of the hairwinding portion of the invention in use adjacent a hair trees.

The hair straightening advantages of the invention are best understood by reference to FIG. 5 showing a diagrammatic perspective view of a tress of hair 50, the hairwinding portion 14 being moved in the direction of the arrow. Since row 26 is obscured in FIG. 5, the path of hair tress 50 relative to the hairwinding poriton is also shown as a dotted line 50 in FIG. 2. The hair need only pass through one row 20 in order to provide sufficient tension to keep the portion of the hair 50 straight. It will be noted that since there are no bristles extending outwardly from the barrel surface in the area between rows 20 and 26, the hair tress is permitted to occupy the entire area longitudinally along the barrel. The hair, therefore, lies considerably flatter on the barrel than if it were bunched up by a plurality of bristles in this area such as those on prior art hair brushes. This permits more efficient heating of the tress at lower barrel temperatures.

It will be understood by those skilled in the art that numerous other modifications and improvements may be made to the preferred embodiment of the invention disclosed herein without departing from the spirit and scope thereof.

What is claimed is:

1. In a hair brush having a handle and an elongated hairwinding portion attached thereto, the hairwinding portion provided with a plurality of longitudinally spaced bristles along its length, the improvement comprising:

said hairwinding portion provided with only six rows of said bristles, said rows comprising:

a first row of bristles, each bristle in said first row extending radially in a first direction relative to the axis of said hairwinding portion;

a second row of bristles, each bristle in said second row extending radially relative to said axis in a second direction diametrically opposite to said first direction;

a third and fourth row of bristles, each bristle in said third and fourth rows extending parallel to said first direction, said third and fourth rows being displaced on opposite sides of said first row by predetermined first and second distances, respectively; and a fifth and sixth row of bristles, each bristle in said fifth and sixth rows extending parallel to said second direction, said fifth and sixth rows being displaced on opposite sides of said second row by predetermined third and fourth distances, respectively.

2. A hair brush according to claim 1 wherein said third and fifth rows are coplanar and said fourth and sixth rows are coplanar.

3. A hair brush according to claim 2 wherein said hairwinding portion has a cylindrical base and said third and fifth rows are tangential thereto and said fourth and sixth rows are tangential thereto.

4. A hair brush according to claim 1 wherein all said bristles are of equal length.

5. A hair brush according to claim 1 further comprising tactile index means for providing to the user an indication of the orientation of said hairwinding portion relative to the user's hand.

* * * * *